US005609655A

United States Patent [19]

Kesseli et al.

[11] Patent Number: 5,609,655

[45] Date of Patent: Mar. 11, 1997

[54] GAS TURBINE APPARATUS

[75] Inventors: James B. Kesseli, Mont Vernon, N.H.; Eric R. Norster, Notts, England

[73] Assignee: Northern Research & Engineering Corp., Woburn, Mass.

[21] Appl. No.: 359,231

[22] Filed: Dec. 19, 1994

Related U.S. Application Data

[62] Division of Ser. No. 113,500, Aug. 27, 1993, Pat. No. 5,450,724.

[51] Int. Cl.[6] ..... C10K 3/06; F02M 23/00; F02C 7/22

[52] U.S. Cl. ..... 48/180.1; 48/189.3; 60/737; 60/746; 60/748

[58] Field of Search ..... 60/737, 738, 742, 60/743, 746, 748, 39.06; 48/180.1, 189.3; 431/354, 2, 12; 261/79.1, 115

[56] References Cited

U.S. PATENT DOCUMENTS

| | | | |
|---|---|---|---|
| 2,860,694 | 11/1958 | Edens et al. | 48/180.1 |
| 3,078,672 | 2/1963 | Meurer . | |
| 3,081,818 | 3/1963 | Brosner et al. | 48/180.1 |
| 3,667,221 | 6/1972 | Taylor | 261/79.1 |
| 3,722,216 | 3/1973 | Bahr et al. | 60/737 |
| 3,938,326 | 2/1976 | DeCorso et al. | 60/737 |
| 3,996,315 | 12/1976 | Herail | 48/198.3 |
| 4,040,251 | 8/1977 | Heitmann et al. | 60/39.36 |
| 4,081,957 | 4/1978 | Cox | 60/727 |
| 4,100,733 | 7/1978 | Striebel et al. | 60/737 |
| 4,215,535 | 8/1980 | Lewis | 261/79.1 |
| 4,262,482 | 4/1981 | Roffe et al. | 60/738 |
| 4,395,223 | 7/1983 | Okigami et al. | 431/10 |
| 4,671,069 | 6/1987 | Sato et al. | 60/737 |
| 4,735,052 | 4/1988 | Maeda et al. | 60/733 |
| 4,898,001 | 2/1990 | Kuroda et al. | 60/733 |
| 4,901,524 | 2/1990 | Shekleton et al. | 60/39.465 |
| 4,926,645 | 5/1990 | Iwai et al. | 60/723 |
| 4,928,481 | 5/1990 | Joshi et al. | 60/737 |
| 5,085,575 | 2/1992 | Keller et al. | 431/354 |
| 5,156,002 | 10/1992 | Mowill | 60/738 |
| 5,220,794 | 6/1993 | Sledd et al. | 60/743 |
| 5,241,818 | 9/1993 | Shekleton et al. | 60/738 |
| 5,307,634 | 5/1994 | Hu | 60/743 |
| 5,319,923 | 6/1994 | Leonard et al. | 60/737 |
| 5,341,645 | 8/1994 | Ansart et al. | 60/746 |

FOREIGN PATENT DOCUMENTS

| | | | |
|---|---|---|---|
| 0253469 | 1/1988 | Germany | 431/354 |
| 0016709 | 1/1982 | Japan | 431/354 |
| 0155108 | 6/1989 | Japan | 431/354 |

OTHER PUBLICATIONS

Radhakrishnan, J. B. Heywood, R. J. Tabaczynski "Premixing Quality and Flame Stability: A theoretical and Experimental Study", NASA CR 3216, Dec. 1979.

*Primary Examiner*—Robert J. Warden
*Assistant Examiner*—Hien Tran
*Attorney, Agent, or Firm*—Michael H. Minns

[57] ABSTRACT

A fuel and air mixing apparatus for a combustor and gas turbine generator. A primary portion of the fuel is injected into the mixing air at long distances from the combustor prechamber. The primary portion of the fuel is almost completely mixed with the mixing air. A secondary portion of fuel is injected into the mixing air in the boundary layer at a short distance form the combustor prechamber. This minimally mixed second portion provides some rich portions of fuel-air in the prechamber to improve stability and reduce the chances of blowout.

6 Claims, 4 Drawing Sheets

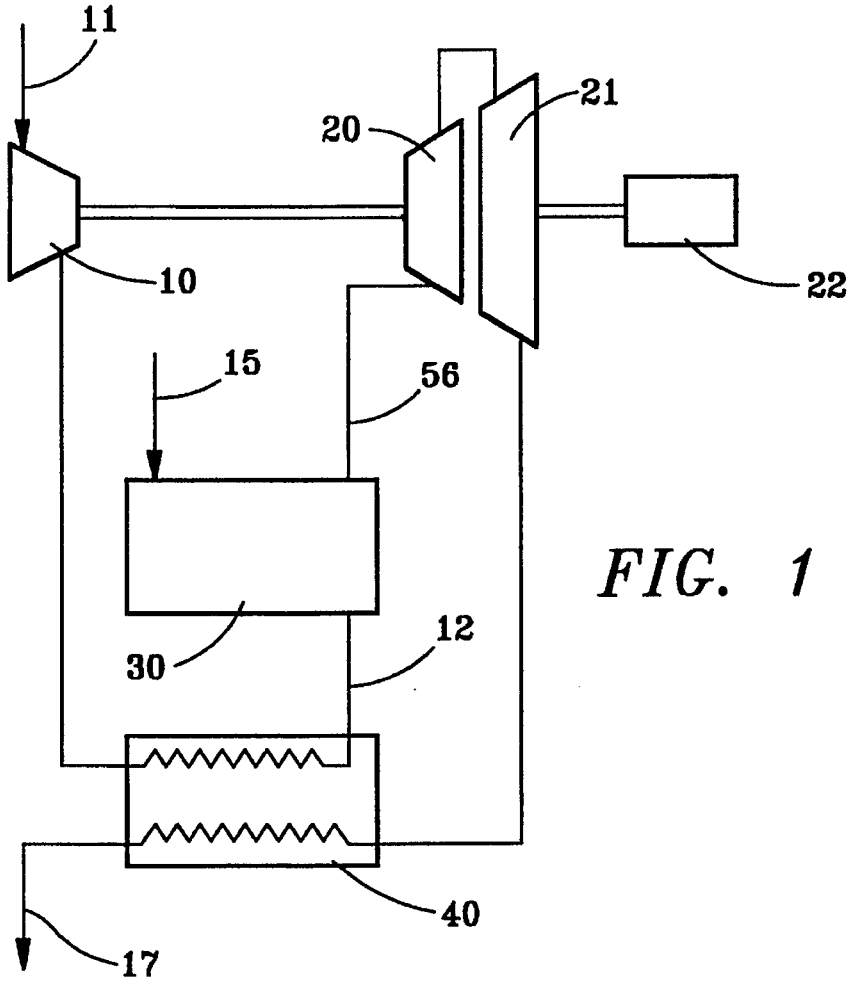
FIG. 1
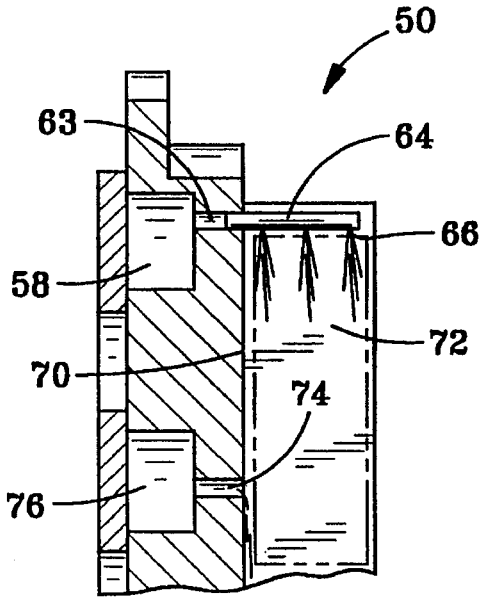
FIG. 4
FIG. 4A
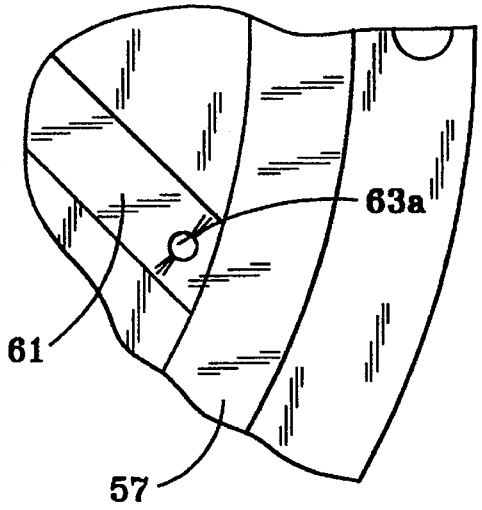

GAS TURBINE APPARATUS

This is a division of application Ser. No. 08/113,500 filed Aug. 27, 1993, now U.S. Pat. No. 5,450,724.

BACKGROUND OF THE INVENTION

This invention relates generally to combustors for gas turbine engines and more particularly to combustors which produce very low emissions of the oxides of nitrogen ($NO_x$).

Normally, it is not possible to maintain stable combustion conditions (equivalence ratio and temperature), with low $NO_x$ over a wide engine operating range without actively controlling, adjusting, or actuating any combustor components, or injecting water into the combustion.

The foregoing illustrates limitations known to exist in present gas turbine combustors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a combustor for a gas turbine comprising: a combustion chamber; and a mixing means for mixing compressed air with a fuel, the mixing means having a plurality of mixing channels, each mixing channel having an entrance, an exit in fluid communication with the combustion chamber, and an interior peripheral surface, the mixing channel being divided into two zones, a boundary layer zone adjacent the interior peripheral surface of the mixing channel and a free stream zone, a first portion of fuel being introduced into the free stream zone of each mixing channel, a second portion of fuel being introduced into the boundary layer zone of each mixing channel.

The foregoing and other aspects will become apparent from the following detailed description of the invention when considered in conjunction with the accompanying drawing figures.

BRIEF DESCRIPTION OF THE DRAWING FIGURES

FIG. 1 is a diagram showing a basic construction of a recuperated gas turbine system;

FIG. 4 is a partial cross-section of a mixing channel in the swirler plate;

FIG. 4A is a section of a mixing channel showing an alternate fuel conduit.

DETAILED DESCRIPTION

Figure 2:
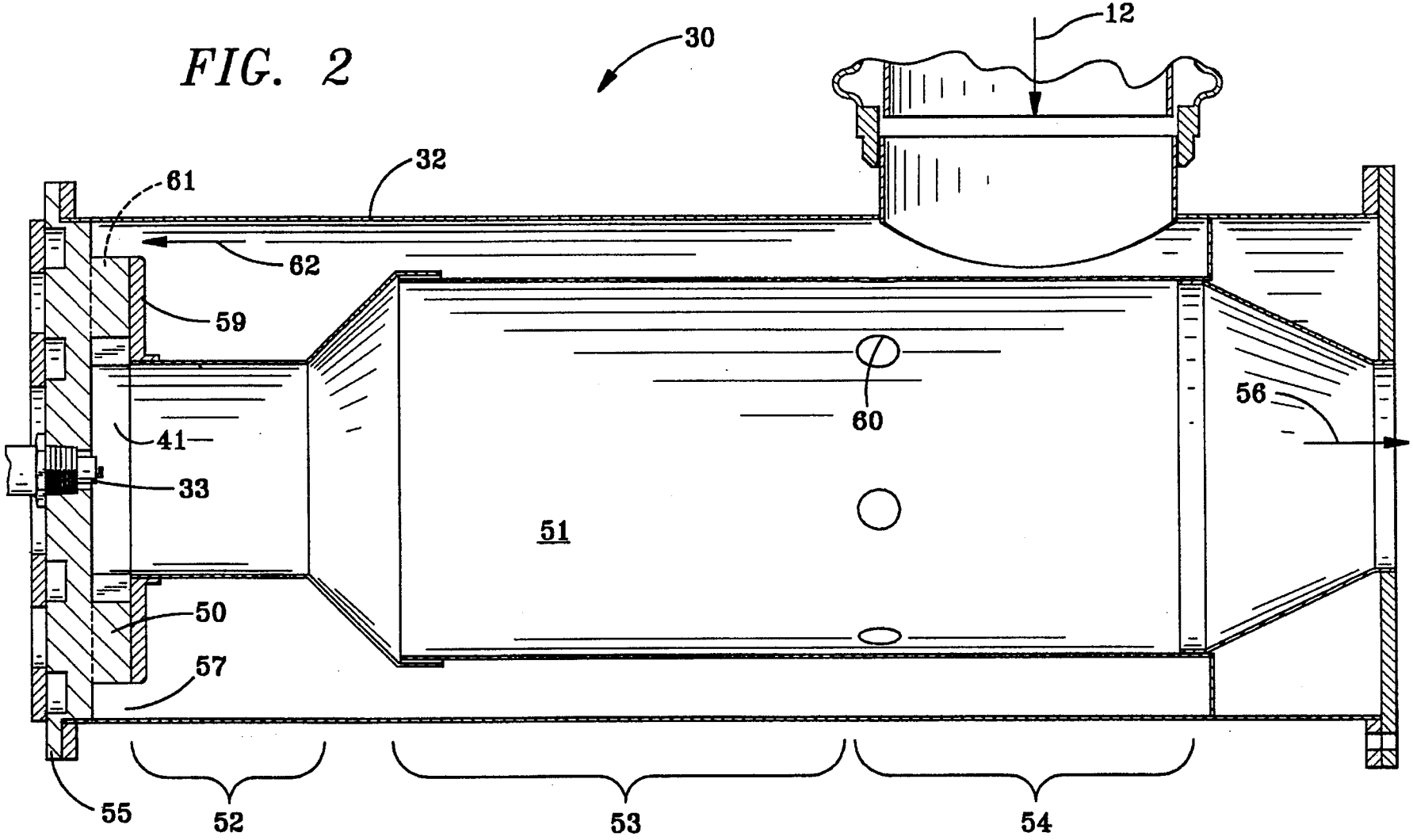
FIG. 2 is a cross-sectional view of a reverse flow can type combustor.

The present invention is a fuel injection design for a recuperated gas turbine engine which regulates the fuel and air mixing. By controlling the degree of fuel and air mixing, low, but stable combustion temperatures are maintained over a wide flow range from starting conditions, up to full power. Fuel and air mixing is controlled by the location of fuel injection jets in a long prechamber swirler. To minimize $NO_x$ emissions, a lean fuel mixture is desired.

FIG. 1 shows a schematic diagram showing a basic recuperated gas turbine system. The present invention is believed to work best with recuperated systems, but is also applicable to non-recuperated gas turbine systems. An air compressor 10 compresses inlet air 11 to a high-pressure. The compressed inlet air 12 passes through an external recuperator 40, or heat exchanger, where exhaust gas 17 pre-heats the compressed inlet air 12. The heated compressed inlet air is mixed with fuel 15 in a combustor 30 where the mixed fuel and air is ignited. The high temperature exhaust gas 56 is supplied first to a compressor turbine 20 and then to a power turbine 21. The compressor turbine 20 drives the air compressor 10. Power turbine 21 drives an electrical generator 22. Typically, a speed reduction gearing assembly (not shown) is used to connect the power turbine 21 to the electrical generator 22. Other arrangements of these components may be used. For example, a single turbine can be used to drive both the air compressor 10 and the electrical generator 22.

Figure 5:
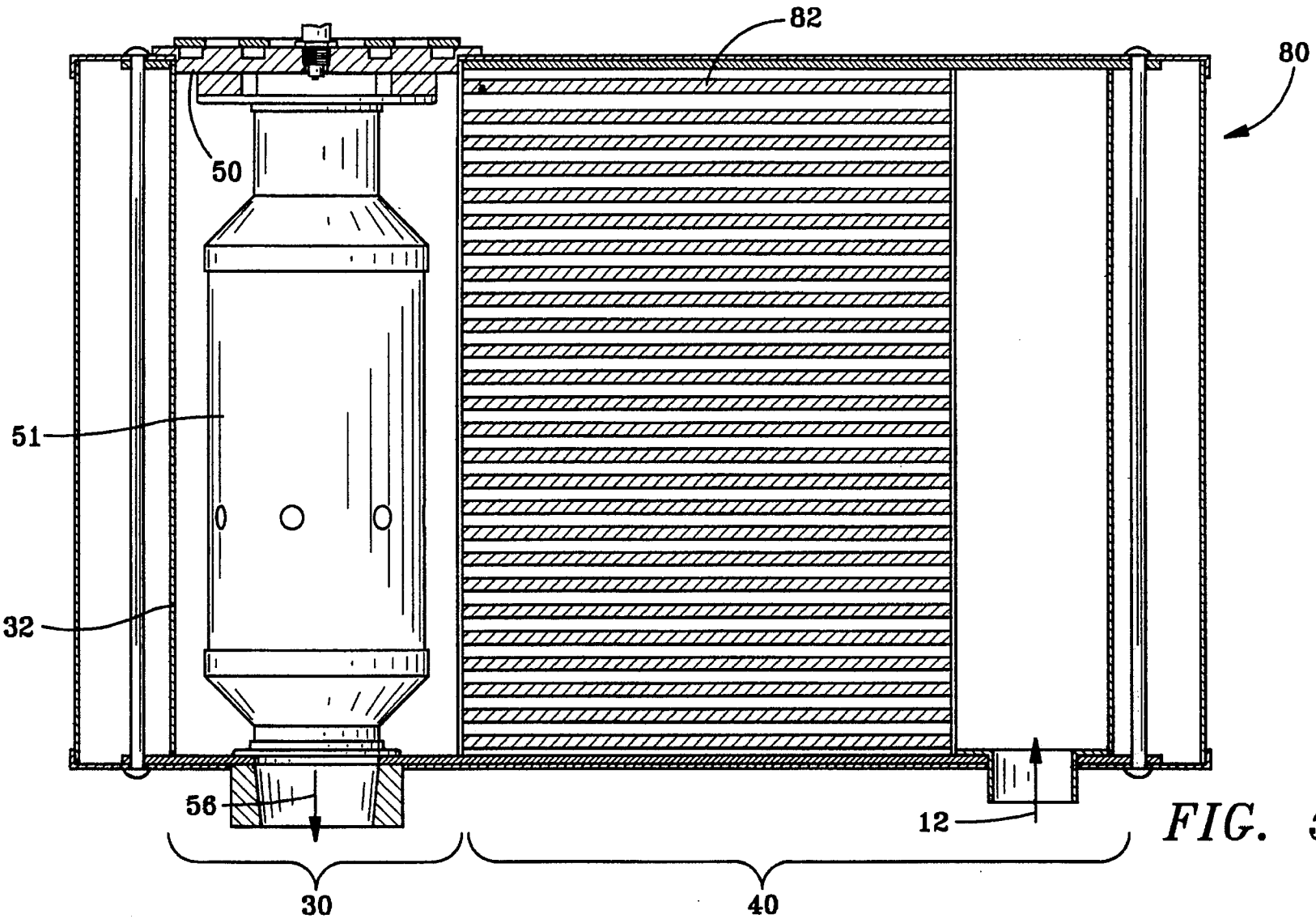
FIG. 5 is a cross-sectional view of an alternate embodiment of a can type combustor with an integral recuperator.

One embodiment of the combustor 30 is shown in FIG. 2, where the recuperator 40 is separate from the combustor 30. An alternate embodiment is shown in FIG. 5 where the combustor 30 and the recuperator 40 are combined in a single integral unit 80. The combustor 30 shown in FIG. 2 is a reverse flow combustor where the compressed inlet air 12 flows counter to the high temperature exhaust gas 56. The compressed inlet air 12 enters the combustor housing 32 near the exhaust end of the combustion chamber 51 of the combustor 30. The counter flowing compressed inlet air 12 provides cooling to the combustion chamber 51. The combustion chamber 51 is divided into three zones, a prechamber zone 52, a secondary zone 53 and a dilution zone 54. The compressed inlet air 12 is divided into at least two portions, a first portion entering the dilution zone 54 through dilution air inlets 60, a second portion (if needed) entering the secondary zone 53 through secondary air inlets (not shown), a third portion providing mixing air 62 to a mixing plate or swirler 50 where fuel 15 and mixing air 62 are mixed prior to entering the prechamber zone 52 where combustion occurs. An ignitor 33 is provided in the swirler 50 to initially ignite the mixed fuel and air. In the combustion chambers shown in FIGS. 2 and 5, compressed inlet air 12 is not provided to the secondary zone 53. This reduces the production of CO in the combustion chamber and allows the present gas turbine apparatus to meet current environmental limitations on CO emissions without the use of additional post combustion treatment or controlling combustion conditions. Compressed inlet air 12 may be provided to the secondary zone 53, if required.

Figure 3:
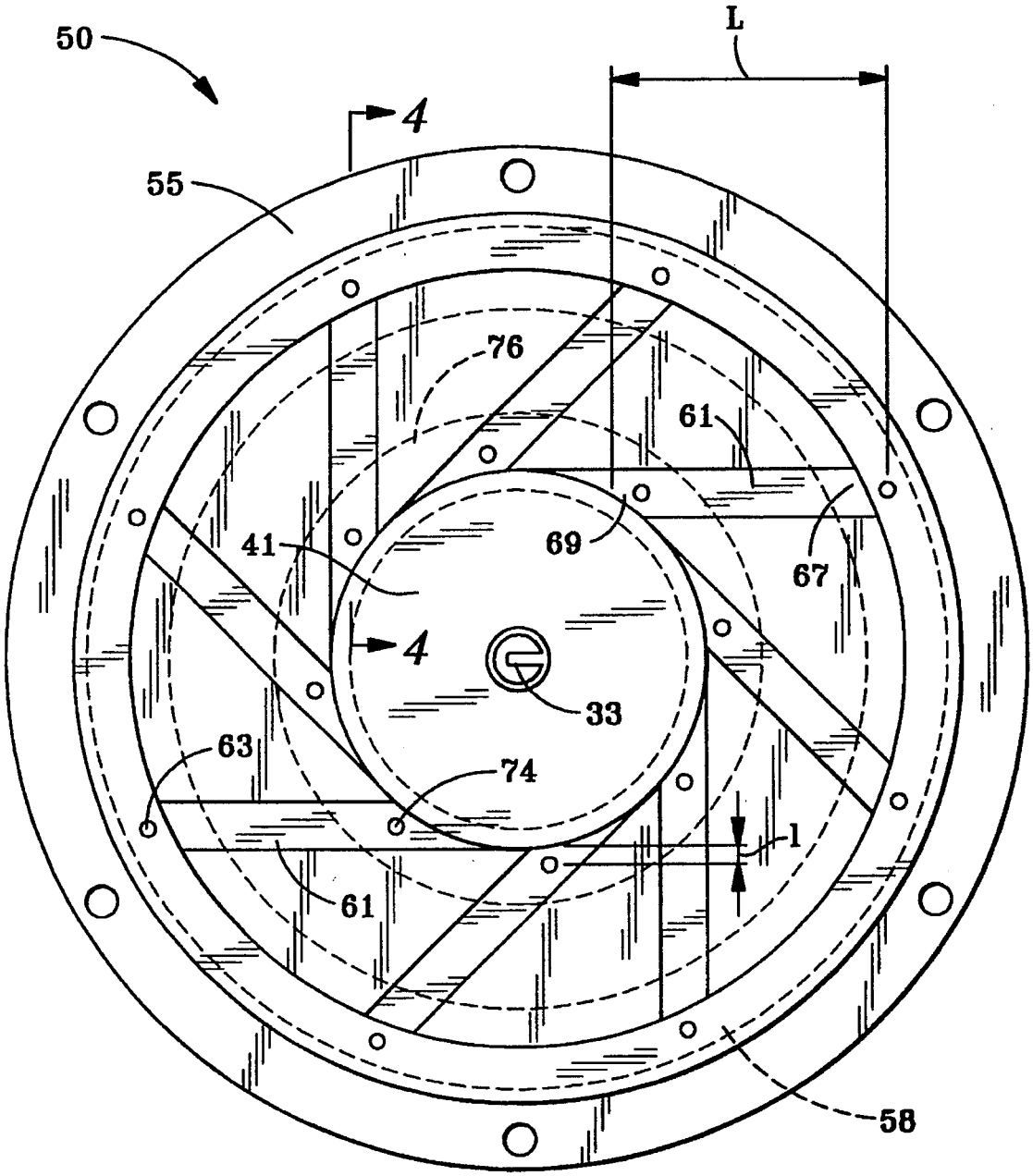
FIG. 3 is a plan view of the swirler plate of FIG. 2.

The details of the swirler 50 are shown in FIGS. 3 and 4. The swirler 50 consists of a circular base plate 55 which is attached to the prechamber zone 52 of the combustion chamber 51. The outer portion of the base plate 55 in combination with the combustor housing 32 and the combustion chamber 51 forms a circular annulus 57. Mixing air 62 enters this annulus 57 and is distributed to a plurality of mixing channels 61. Each mixing channel is divided into two zones, a boundary layer zone 70 proximate the inner peripheral surfaces of the mixing channel 61 which includes the boundary layer flow and a free stream zone 72 which includes the balance of the central portion of the mixing channel 61. The mixing channels 61 are oriented to induce a swirling in the mixed air and fuel as the mixed air and fuel enters the prechamber zone 52. An annular plate 59 attached to the swirler 50 forms the fourth wall of the mixing channel 61.

Primary fuel is introduced into each mixing channel 61 proximate the entrance 67 through a primary fuel inlet 63.

The exits 69 of the mixing channels 61 discharge into a centrally located fuel-air chamber 41 in base plate 55. The primary fuel is introduced into the free stream zone 72. One embodiment of the primary fuel inlet 63 is shown in FIGS. 3 and 4, where the primary fuel inlet 63 is located just before the entrance 67 of the mixing channel 61. A fuel conduit 64 extends into the mixing channel 61. Preferably the fuel conduit 64 extends across the free stream zone 72. A plurality of fuel injectors 66 in the fuel conduit 64 spray fuel 15 into the mixing channel 61. In the preferred embodiment, these fuel injectors 66 are evenly spaced axially along the fuel conduit 64. Where the primary fuel inlet 63 is located just before the entrance 67 of the mixing channel 61, the fuel injectors 66 are oriented to spray fuel 15 down the mixing channel 61. This reduces the possibility of fuel ignition occurring in the air annulus 57. A second embodiment is shown in FIG. 4A where the primary fuel inlet 63*a* is located within the mixing channel 61. For this second embodiment, the fuel injectors 66 are comprised of pairs of apertures oriented to spray the fuel 15 crossways i.e. at an angle not parallel, to the direction the mixing air 62 is flowing in the mixing channel 61. This improves the fuel and air mixing. A primary fuel distributor 58 formed as an integral channel in base plate 55 distributes fuel to the primary fuel inlets 63.

The primary fuel inlets 63 are located a distance L from the exit 69 of the mixing channel 61. The primary fuel inlets are positioned a minimum distance from the exit 69 where this minimum is determined by:

$$\frac{L \times n}{D} > 10$$

L=Distance from primary fuel inlet to mixing channel exit n=Number of fuel injectors in a fuel conduit D=Hydraulic diameter of the mixing channel Normally, the positioning of the primary fuel inlets 63 is measured by the distance L divided by the hydraulic diameter of the mixing channel 61. When a plurality of fuel injectors 66 are used, the mixing channel 61 is effectively divided into a plurality of sub-mixing channels, each with a separate hydraulic diameter D'. Rather than calculate each hydraulic diameter D', the hydraulic diameter D of the mixing channel 61 is divided by the number of fuel injectors 66.

The primary fuel inlets 63 are positioned to approach complete fuel mixing. When using a lean fuel mixture, blowout or instability of the flame can occur as fuel mixing approaches a fully mixed or homogeneous condition. Secondary fuel inlets 74 are provided near the exit of each mixing channel 66. These secondary fuel inlets 74 inject a small amount of fuel in the boundary layer zone 70. A secondary fuel distributor 76 formed as an integral channel in base plate 55 distributes fuel to the secondary fuel inlets 74. Positioning of the secondary fuel inlets 74 near the mixing channel exit 69 and injecting into the boundary layer zone 70 minimizes the mixing of the secondary fuel and air. This provides regions of richness in the prechamber zone 52 which reduces the problem with blowout or instability. The maximum position of the secondary fuel inlets 74 is determined by:

$$\frac{l}{D} < 3$$

l=Distance from secondary fuel inlet to mixing channel exit

D=Hydraulic diameter of the mixing channel

The secondary fuel is primarily required at low load conditions. At mid-power and full power conditions, the secondary fuel is probably not required and can be turned off. Preliminary investigations show that the continued use of the secondary fuel at these higher power conditions is not detrimental to $NO_x$ or CO emissions, and it may not be necessary to turn off the secondary fuel. The preferred ratio of primary fuel to secondary fuel is 95 to 5.

An alternate embodiment of the present invention is shown in FIG. 5. The recuperator 40 is integral with the combustor 30 is a single combined recuperator/combustor unit 80. The recuperator 40 is comprised of a plurality of parallel plates 82 which separate the compressed inlet air 12 from the exhaust gas 17. The exhaust gas 17 flows counter to the compressed inlet air 12. The use of a combined recuperator/combustor 80 reduces the pressure drop between the compressed inlet air 12 entering the recuperator 40 and the heated compressed inlet air 12 entering the combustor housing 32.

Having described the invention, what is claimed is:

1. An apparatus for mixing compressed air with a fuel, the apparatus comprising:

a base plate, the base plate having a centrally located fuel-air chamber;

a plurality of mixing channels for mixing compressed air and fuel, each mixing channel having an entrance for introduction of compressed air into the mixing channel, an exit in fluid communication with the fuel-air chamber, an interior peripheral surface, a first fuel inlet, the first fuel inlet including a fuel conduit extending from the mixing channel interior peripheral surface for introduction of fuel into the mixing channel, the fuel conduit having at least one fuel injector through which the fuel is introduced into the mixing channel, each mixing channel having a hydraulic diameter (D), the distance from the first fuel inlet to the mixing channel exit defining a first distance (L), the quantity (L×number of fuel injectors per mixing channel/D) being greater than 10, the mixing channels being oriented such that a swirling motion is imparted to the compressed air and fuel such that the compressed air and fuel exits the fuel-air chamber in a vortex configuration, each mixing channel being divided into two zones, a boundary layer zone adjacent the mixing channel peripheral surface and a free stream zone; and a second fuel inlet located in each mixing channel, the second fuel inlet introducing the fuel into the mixing channel boundary zone, the second fuel inlet being positioned a second distance (l) from the mixing channel exit, the ratio of l/D being less than 3.

2. The apparatus according to claim 1, wherein the fuel conduit is within the mixing channel each fuel injector comprising at least one aperture, and the at least one fuel injector aperture is oriented to disperse the fuel at an angle not parallel to the direction in which the compressed air is flowing, the fuel injectors being disposed along the length of the fuel conduit, the majority of the fuel being dispersed into the mixing channel free stream zone.

3. The apparatus according to claim 1, further comprising:

a first fuel distributor integral with the base plate, the first fuel distributor being in fluid communication with the plurality of first fuel inlets and a second fuel distributor integral with the base plate, the second fuel distributor being in fluid communication with the second fuel inlets.

4. An apparatus for mixing compressed air with a fuel, the apparatus comprising:

a base plate, the base plate having a centrally located fuel-air chamber;

a plurality of mixing channels for mixing compressed air and fuel, each mixing channel having an entrance for introduction of compressed air into the mixing channel, an exit in fluid communication with the fuel-air chamber, an interior peripheral surface, each mixing channel being divided into two zones, a boundary layer zone adjacent the mixing channel peripheral surface and a free stream zone, a first fuel injection means for injecting fuel into the mixing channel free stream zone, the first fuel injection means being proximate the mixing channel entrance and a second fuel injection means for injecting fuel into the boundary layer zone, the second fuel injection means being proximate the mixing channel exit.

5. The apparatus according to claim 4, wherein the first fuel injection means includes a fuel conduit having at least one fuel injector through which the fuel is introduced into the mixing channel and each mixing channel has a hydraulic diameter (D), the distance from the first fuel injection means to the mixing channel exit defining a first distance (L), the quantity (L×number of fuel injectors per mixing channel/D) being greater than 10.

6. The apparatus according to claim 5, wherein the distance from the second fuel injection means to the mixing channel exit defines a second distance (l), the ratio of l/D being less than 3.

* * * * *